US005937749A

United States Patent [19]

Ford

[11] Patent Number: 5,937,749

[45] **Date of Patent: *Aug. 17, 1999**

[54] MODULAR SILK SCREEN PRINTING APPARATUS

[76] Inventor: Garey W. Ford, 844 Cooper St., Edgewater Park, N.J. 08010

[ * ] Notice: This patent issued on a continued prosecution application filed under 37 CFR 1.53(d), and is subject to the twenty year patent term provisions of 35 U.S.C. 154(a)(2).

[21] Appl. No.: 08/971,234

[22] Filed: Nov. 15, 1997

Related U.S. Application Data

[60] Provisional application No. 60/030,563, Nov. 15, 1996.

[51] Int. Cl.[6] ..... B41F 15/04

[52] U.S. Cl. ..... 101/115; 101/126

[58] Field of Search ..... 101/114, 115, 101/123, 126, 127.1, 129

[56] References Cited

U.S. PATENT DOCUMENTS

| | | | |
|---|---|---|---|
| 4,287,826 | 9/1981 | Brabec | 101/115 |
| 4,671,174 | 6/1987 | Tartaglia et al. | 101/115 |
| 4,813,351 | 3/1989 | Pierson, Jr. | 101/115 |
| 5,136,938 | 8/1992 | Pallegrina | 101/115 |
| 5,456,172 | 10/1995 | Hermann | 101/115 |

*Primary Examiner*—Ren Yan

*Attorney, Agent, or Firm*—Donald C. Simpson

[57] ABSTRACT

A silk screen printing apparatus of modular design which can be easily assembled and disassembled and easily transported on an ordinary hand truck in which there can be repetitive multi-color patterns printed on a plurality of like articles with precise registration of the silk screens and in which there can be an additional heating and drying mechanism as a separate, compatible, modular unit such as to permit in-line printing of fabric such as T-shirts and the drying of the printed T-shirts.

2 Claims, 17 Drawing Sheets

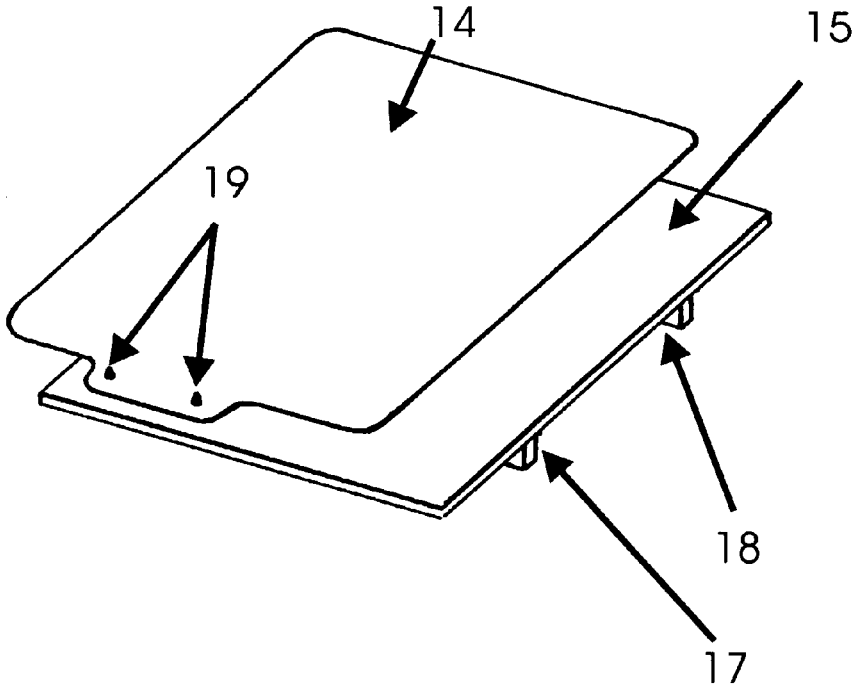
Fig 5A
Fig 5 B-1
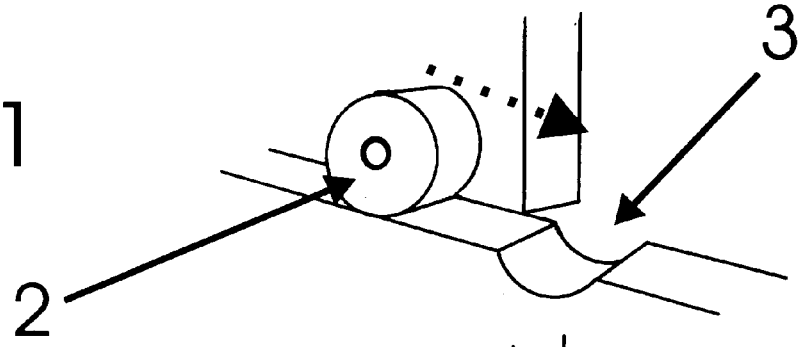
Fig 5 B-2
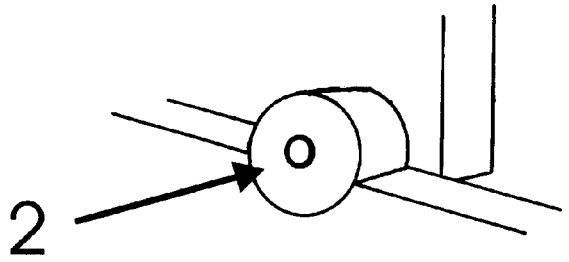

Fig. 12
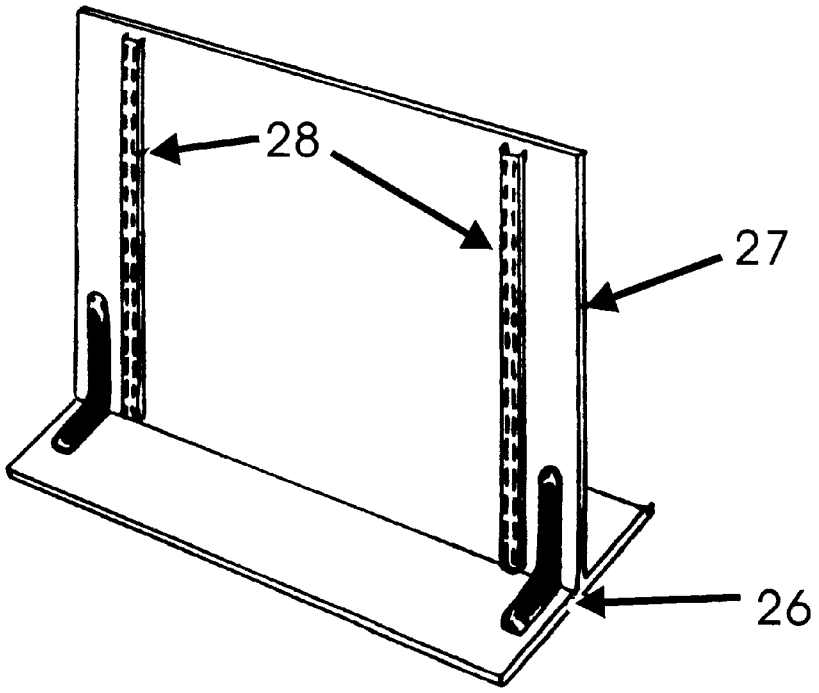
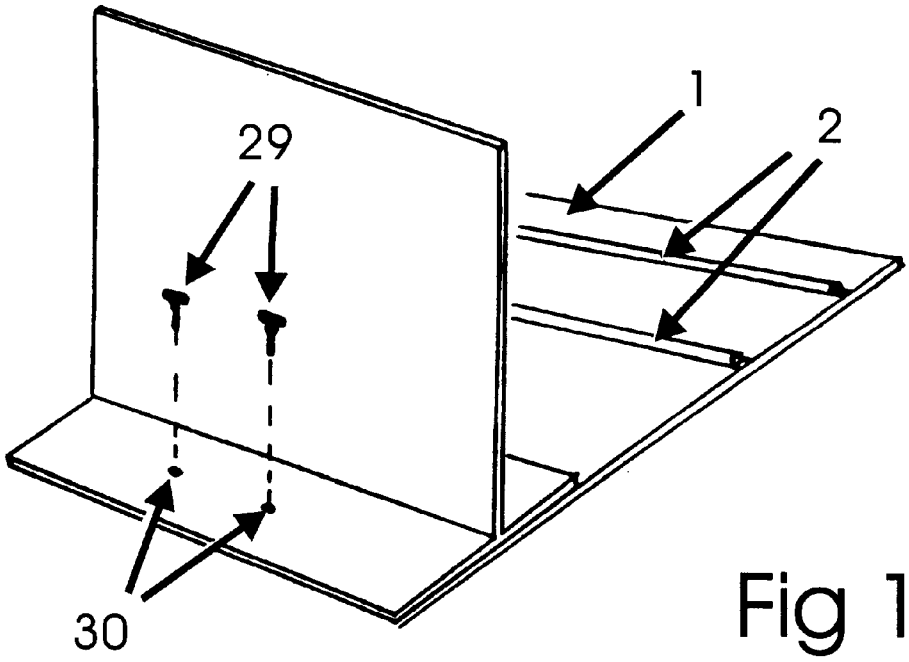
Fig 13

MODULAR SILK SCREEN PRINTING APPARATUS

This application claims benefit of Provisional Application No. 60/030,563, filed Nov. 15, 1996.

BACKGROUND OF THE INVENTION

1. Field of the Invention

The present invention relates to the art of silk screen printing and, more particularly, to a modular apparatus which can, by means of an ordinary hand truck, be readily moved from place to place, and quickly set up and operated. Such apparatus finds particular use at places such as county fairs, conventions, et cetera, as well as its being useful to the smaller organizations that have fundraisers in which T-shirts and other items are printed for sale.

2. Description of the Prior Art

There is a great body of prior art relating to the field of silk screen printing of varying complexity. At one end of the spectrum is the original silk screen concept in which simple silk screens were prepared for each individual color to be used in the silk screen process, hand-held during operation, and manually put in register from one print to the other. At the other end of the spectrum are the complex, fully automatic, silk screen printing machines such as those illustrated in Schwarzberger U.S. Pat. No. 2,846,946, Pierson U.S. Pat. No. 4,813,351, Pellegrina U.S. Pat. No. 5,136,938, and Herrmann U.S. Pat. No. 5,456,172. Of somewhat less complexity is the silk screen printing machine of Proffer U.S. Pat. No. 5,127,321. All of these silk screen printing machines provide excellent results, but are far too complex, massive, and expensive to be moved from place to place at will and, for all practical purposes, are only directed to the high volume printing market.

There have been a number of attempts to produce an intermediate, essentially manual silk screen printing machine. U.S. Pat. No. 4,671,174 to Tartaglia, et al, is a good example of such attempts. Even these machines, however, are somewhat complex and a bit too heavy and massive to permit their easy transportation. Further, such machines require repeated handling and registration of the silk screens, and a great deal of time and effort is consumed in trying to ensure that there is good registration from one screen to another. If registration of each screen is not carefully performed, an imprecise and unattractive printed product may result.

SUMMARY OF THE INVENTION

It is an object of the present invention to provide a silk screen printing apparatus of modular design in which the various modular units can be assembled and disassembled with ease, and where the entire unit may be readily taken apart and transported on an ordinary hand truck.

It is a further object of the invention to provide such a modular unit in which there can be repetitive, multi-color patterns printed on a plurality of like articles with precise registration of the silk screens.

An additional object of the present invention is to provide a heating and drying mechanism as a separate modular unit that is compatible with the printing modular units so as to permit in-line printing and drying of the T-shirts or other items being printed.

These objects of the invention are achieved through the use of a plurality of modular printer platforms, the number of modules being equal to the number of silk screens utilized for printing, plus an additional module if in-line drying is to be utilized. Each of the modules is adapted to receive a removable screen tower which can be rigidly but removably attached to the module. Where it is desired to perform in-line drying, a dryer support is similarly provided to be rigidly, but removably mounted to a module unit. Each of the modular printer platforms is provided with a plurality of parallel tracks or guides designed to interconnect with the tracks or guides of an adjacent modular unit so as to provide a plurality of parallel tracks or guides beginning with the first module and connecting continuously with the other modules through to the final module. A movable, fabric-holding platform is provided, adapted to be placed on and moved along said parallel tracks or guides. In normal use, a modular unit is included for each color to be printed, and each such module is provided with a screen tower. The silk screen for that particular color is affixed to the appropriate screen tower in a manner that permits rigid connection and fixed registration of the screen throughout the printing process for which the screen is to be used. The printing tower is designed to permit the screen to be lowered onto the fabric to be printed and then raised, while retaining the original registration position. If desired, a final module is provided in which, instead of a screen tower, a dryer support is mounted, and a dryer is placed in position as the final stage. The fabric to be printed is placed onto and fixed to the print-side of the fabric-holding platform, and the fabric-holding platform is placed in appropriate position on the tracks or guides of the first printer platform. The screen which is rigidly but removably attached to the screen tower is lowered onto the fabric to be printed, and the silk screening process and application of ink is completed with a squeegee in the usual manner. The silk screen is then raised by means of the screen tower, and the printing platform is rolled or slid to the next module where the process is repeated again, and the entire process is repeated according to the number of colors being used. Where in-line drying is used after printing with the final color, the printing platform is rolled or slid to its position on the final module, the dryer is activated, and the printed fabric is dried to the necessary degree.

BRIEF DESCRIPTION OF THE DRAWINGS

FIGS. 5A, B-1, B-2, C and D illustrate, in perspective, a movable, fabric-holding platform commonly referred to as a "rolling chase." FIGS. 5B-1, and B-2, showing respectively underside wheels of the rolling chase approaching and entering into the modular printer platform registry notches.

FIG. 12 is a front view of a T-shaped heater support which can be mounted on and used with the modular printer platforms of the present invention.

FIG. 13 is a rear view of the support member of FIG. 12 resting on a modular platform and about to be fastened thereto utilizing the same mounting procedure as was used with mounting screen towers to the modular printer platforms units.

DETAILED DESCRIPTION OF THE DRAWINGS

Figure 1:
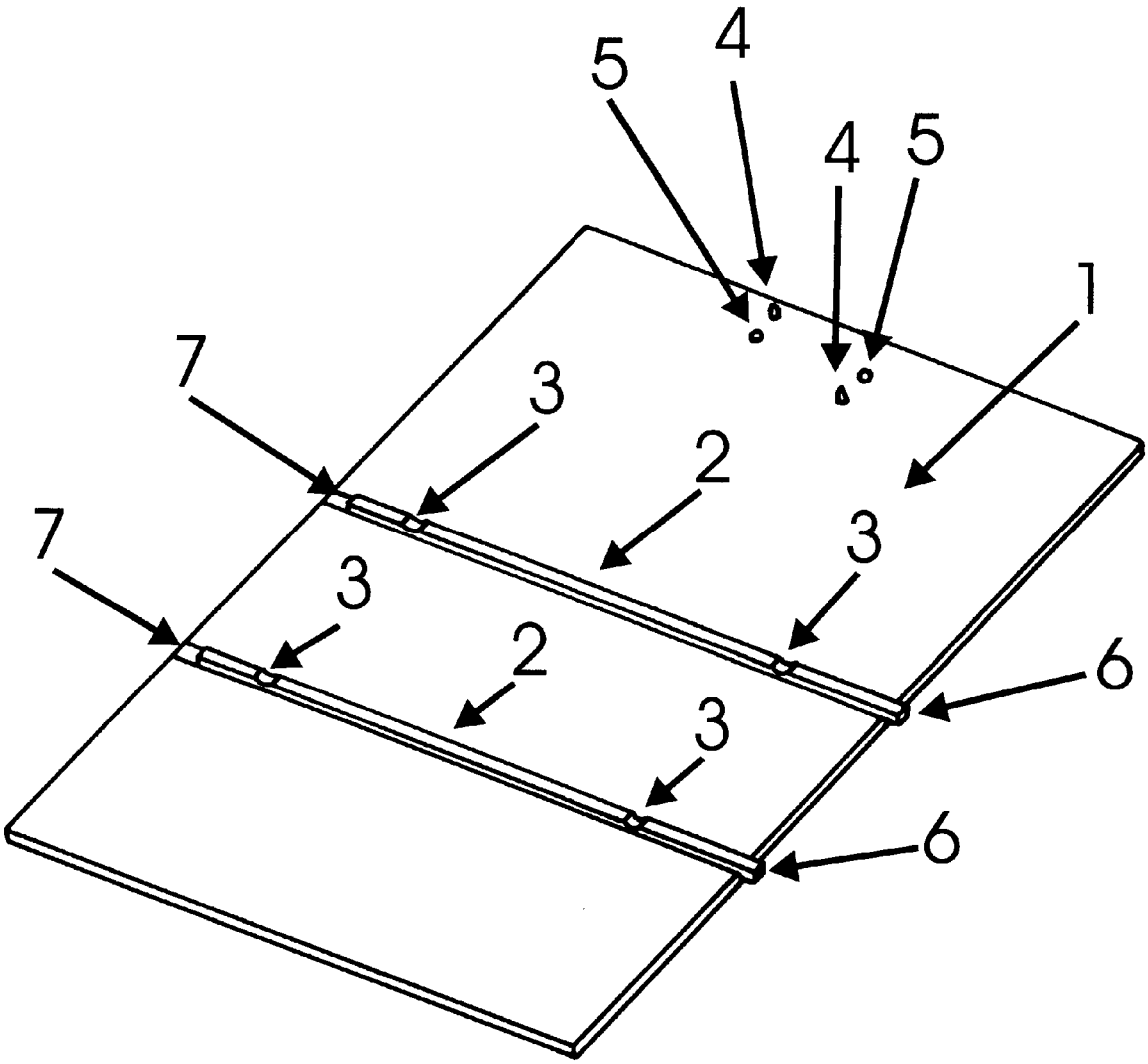
FIG. 1 is a perspective view of one of the modular printer platforms.
Figure 2:
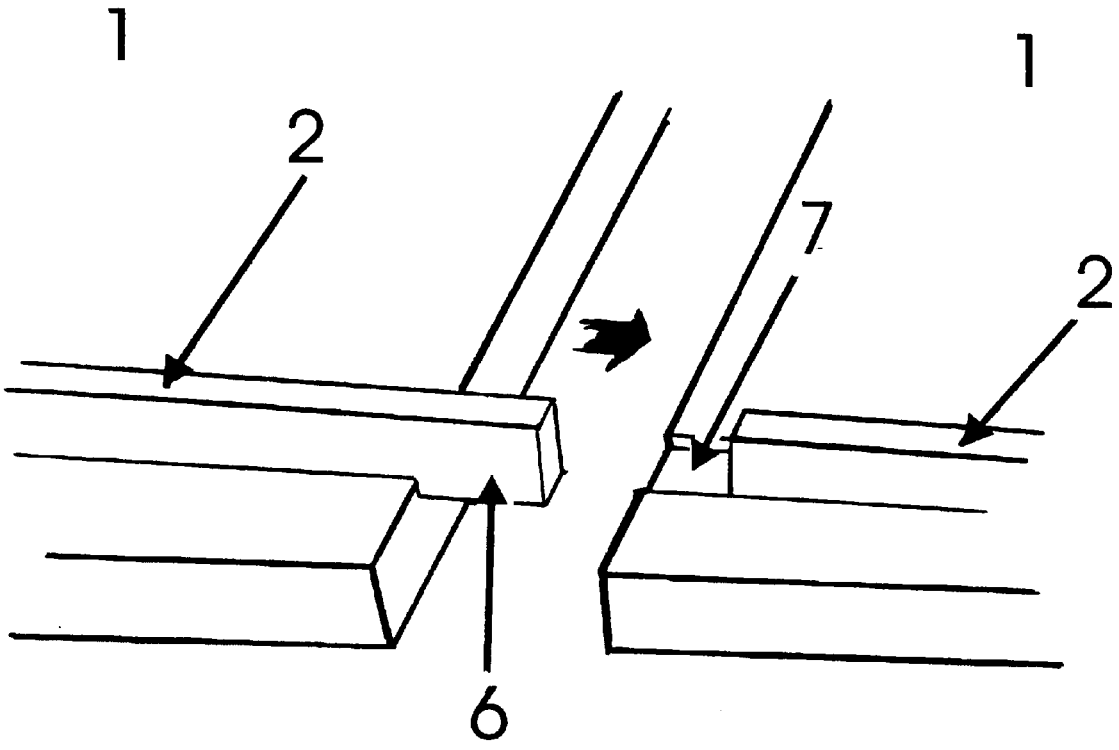
FIG. 2 is a schematic representation of the joining of two of the modular printer platforms of FIG. 1 in which tracks 2 are caused to overlap on one side of the platform and are indented slightly on the other such that, as shown in FIG. 2, when the modular printer platforms are placed side by side, the overlapped portion 6 can insert into the indentation of 7 to give a continuous track that is locked against right angle movement.

The present invention will be described hereinafter in conjunction with three color printing of T-shirts. The silk screen printing apparatus of the present invention comprises a plurality of modular printer platforms, one of which is illustrated in FIG. 1. The platform 1 is sized according to the size of the screens that are to be printed and is provided with a pair of parallel tracks or guides 2, each of which has an appropriately placed rolling chase registry notches 3, screen tower alignment pins 4, and screen tower fastening holes 5.

Figure 3A:
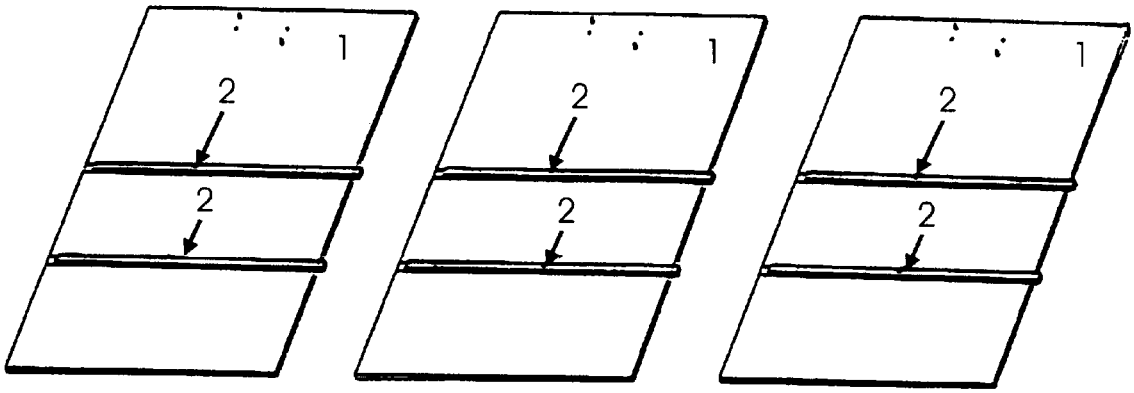
FIGS. 3A and 3B are, respectively, perspective views of three modular printer platforms in side-by-side relationship before joining and after joining to form a continuous track.
Figure 3B:
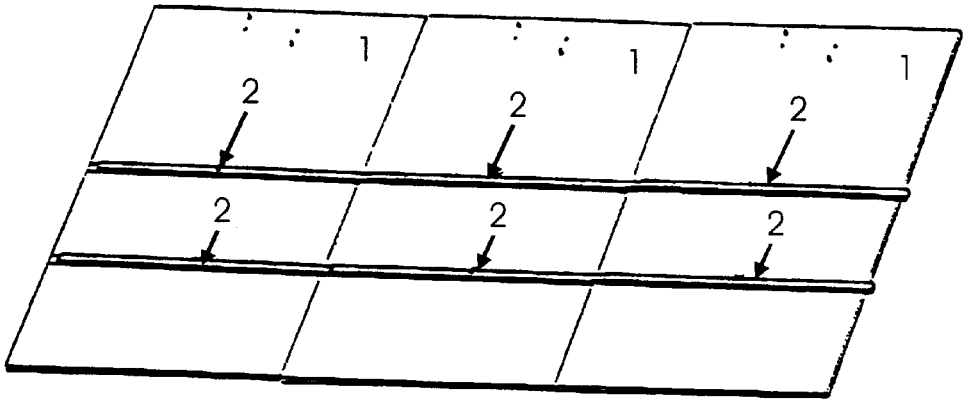

FIG. 3A illustrates three of such modules in separated, but side-by-side relation, and FIG. 3B shows them connected such that the tracks 2 form a continuous parallel track across all three modular platforms. The notches 3, shown in FIG. 1, are omitted from these figures.

Figure 4A:
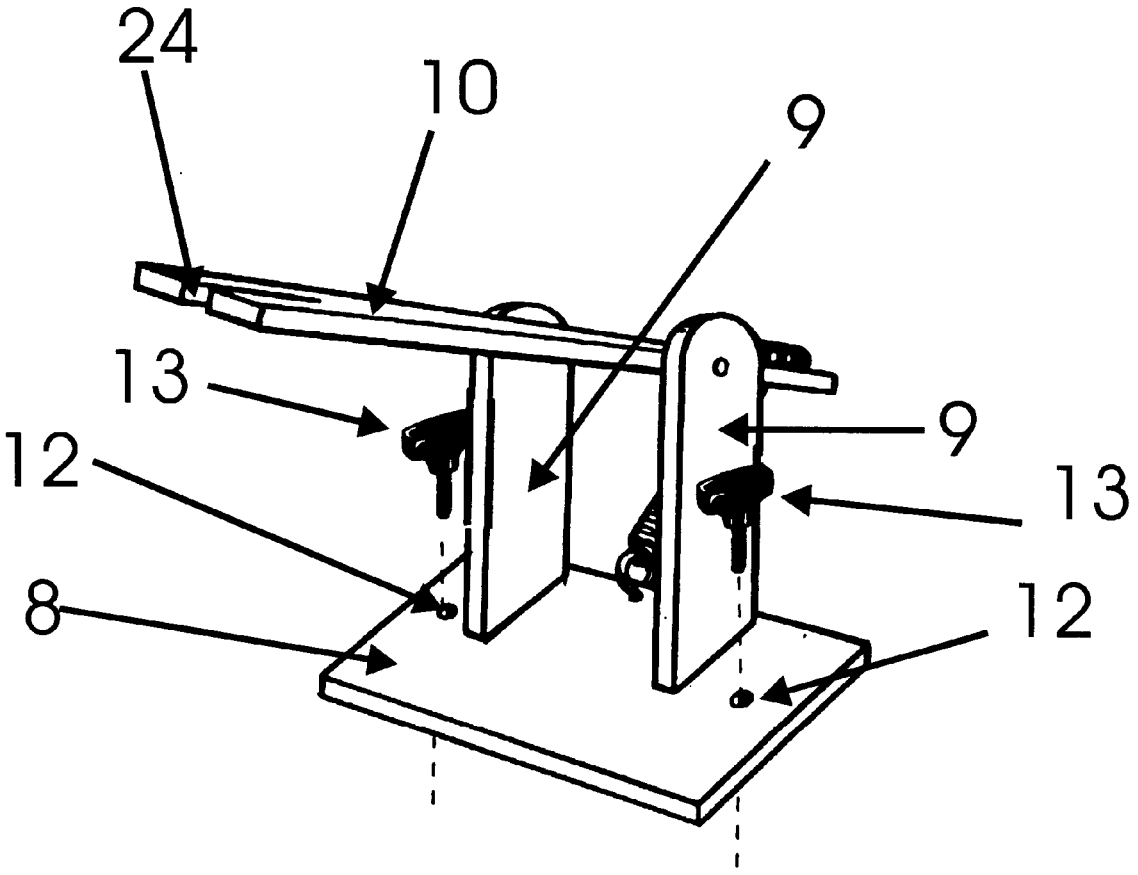
FIGS. 4A and 4B are, respectively, a silk screen tower with holding screws and a silk screen tower with a modular printer platform with holding screws, showing the manner in which the silk screen tower can be mounted rigidly and removably to the modular printer platform.
Figure 4B:
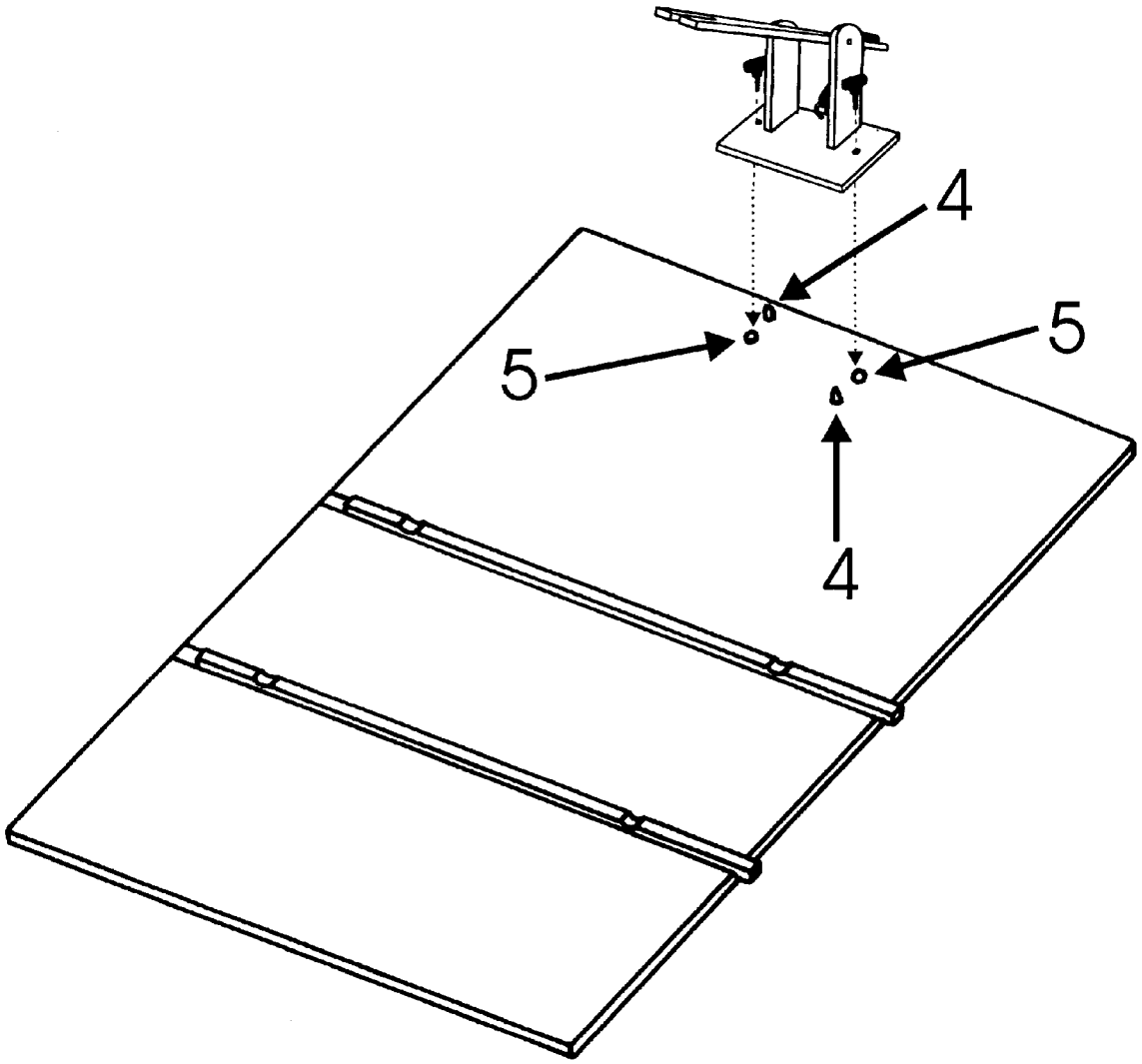

FIG. 4A illustrates a typical screen tower which consists of a mounting base 8, upright supports 9, screen support arm 10, spring 11, connected between base 8 and the remote end of screen support 10 so as to return the screen support to an upright position when the screen support is released. Shown also in FIG. 4A are screw holes 12 and T-bolts 13. Not shown in FIG. 4A is the underside of base 8 having alignment holes for placing the screen tower on a modular printer platform in proper alignment. FIG. 4B shows the screen tower of FIG. 4A positioned above a modular printer platform. Registry pins 4 are positioned to correspond to alignment holes (not shown) under the base 8 of the screen tower such that threaded holes 5 in the modular printer platform will align properly with the holes 12 in the base of the screen tower so that the T-bolts 13 can be tightened into place to hold the screen tower in proper position on the modular platform, as is shown in FIG. 5D.

Figure 5C:
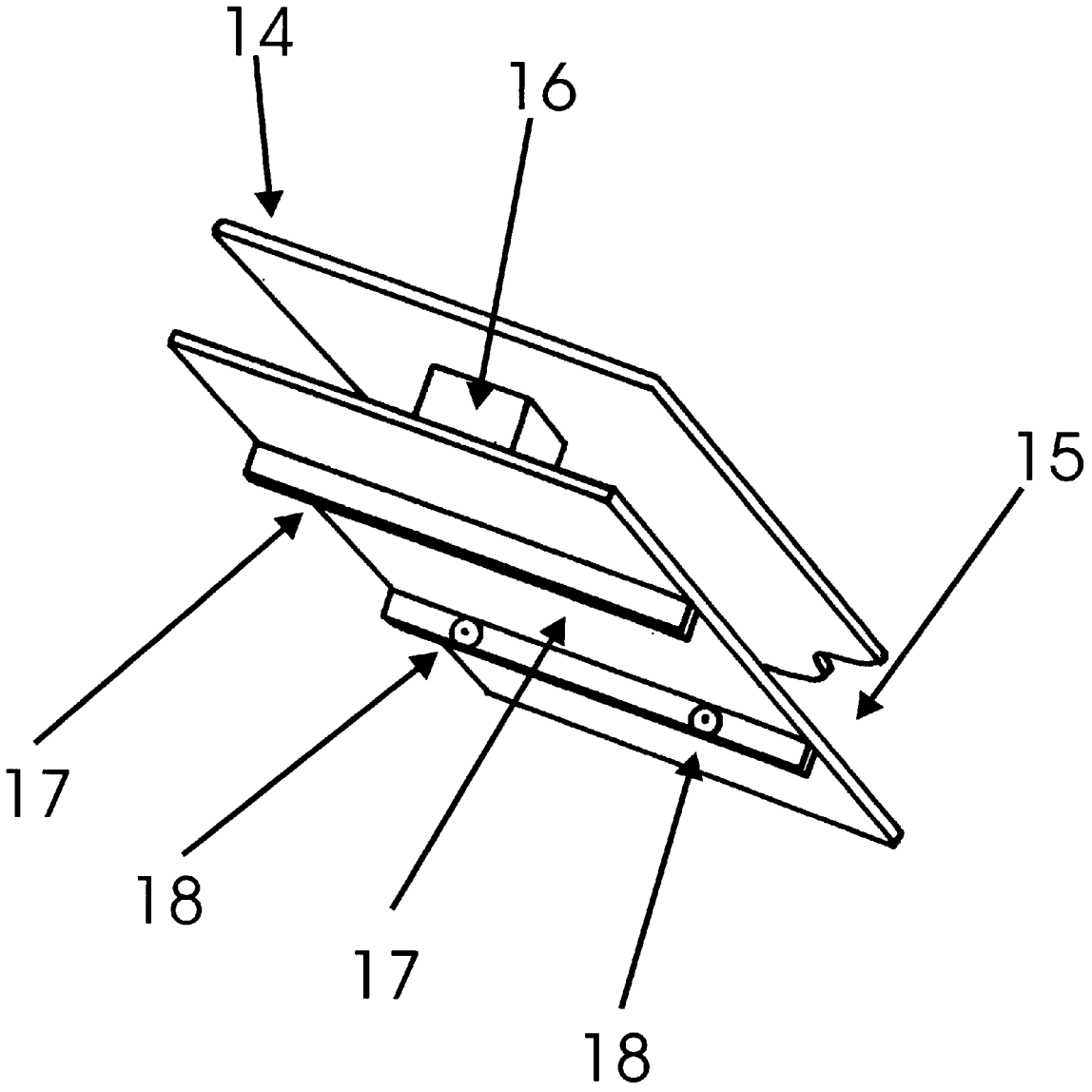
FIG. 5C shows an underside of the rolling chase.

FIG. 5A illustrates the rolling chase used in the present invention. Basically, the rolling chase consists of a fabric platform 14, a support platform 15, a suitable separator 16, wheel supports 17, and wheels 18. As shown in FIG. 5B-1, 5B-2, and 5-D, the wheels of the rolling chase rest on rails 2. When the rolling chase is moved to a position where the wheels engage notches 3, the user knows that the rolling chase is in proper position for full registry of the screen and fabric being printed since these notches are placed in the same location in all modular units. While the notches do not immobilize the rolling chase, they do provide a stable position in which the rolling chase will be at rest until sufficient horizontal force is placed on it to push it further along the tracks and thus the notches in the track provide some degree of support for holding the rolling chase in place during the printing operation at each station. As shown in FIGS. 5A and 5D, the modular printer platform is provided at one end with two or more register pins which form part of the screen registry system, as will be discussed subsequently.

Figure 5D:
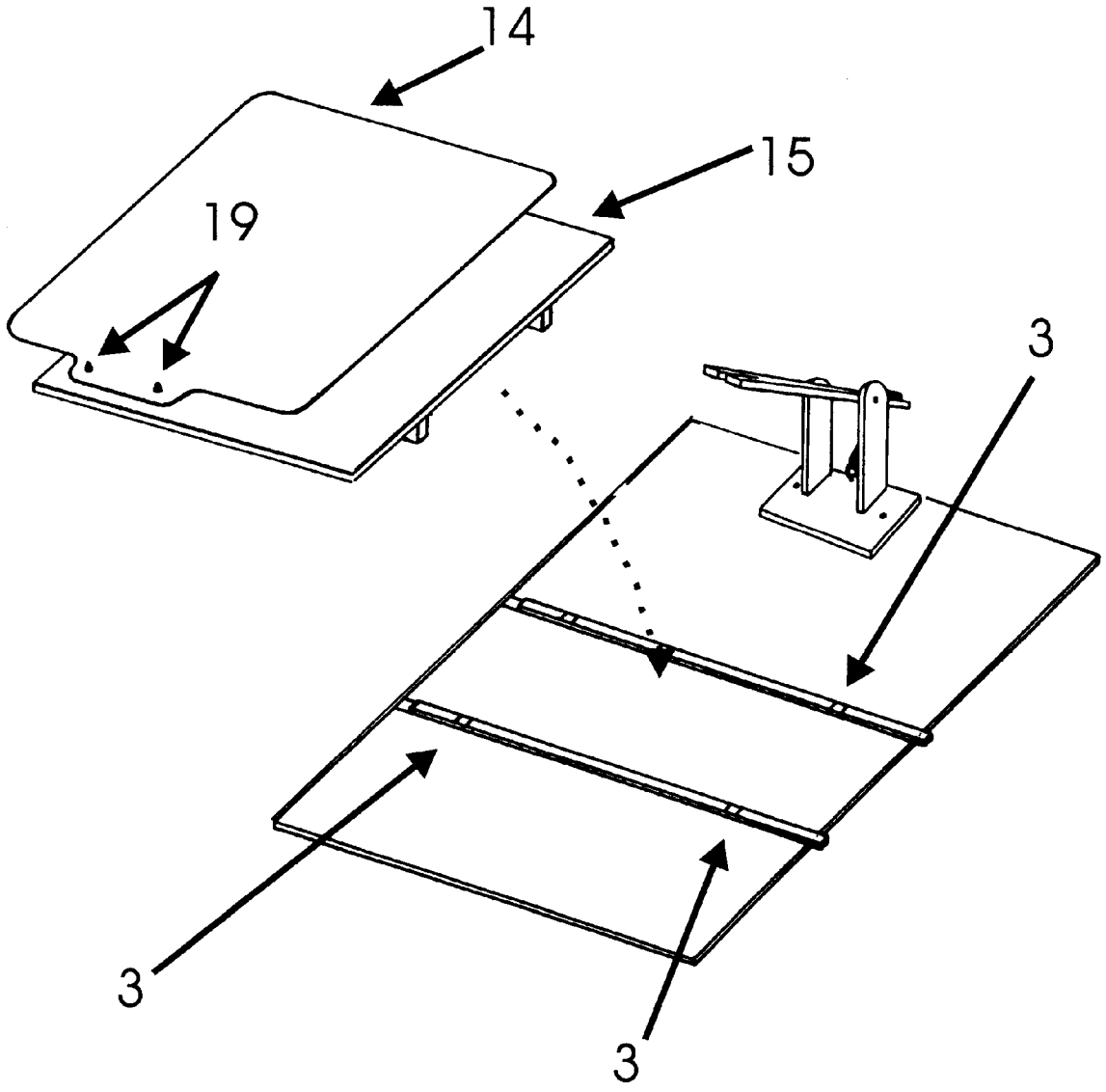
FIG. 5D illustrates the rolling chase being placed on a modular printer platform already equipped with screen tower.
Figure 6:
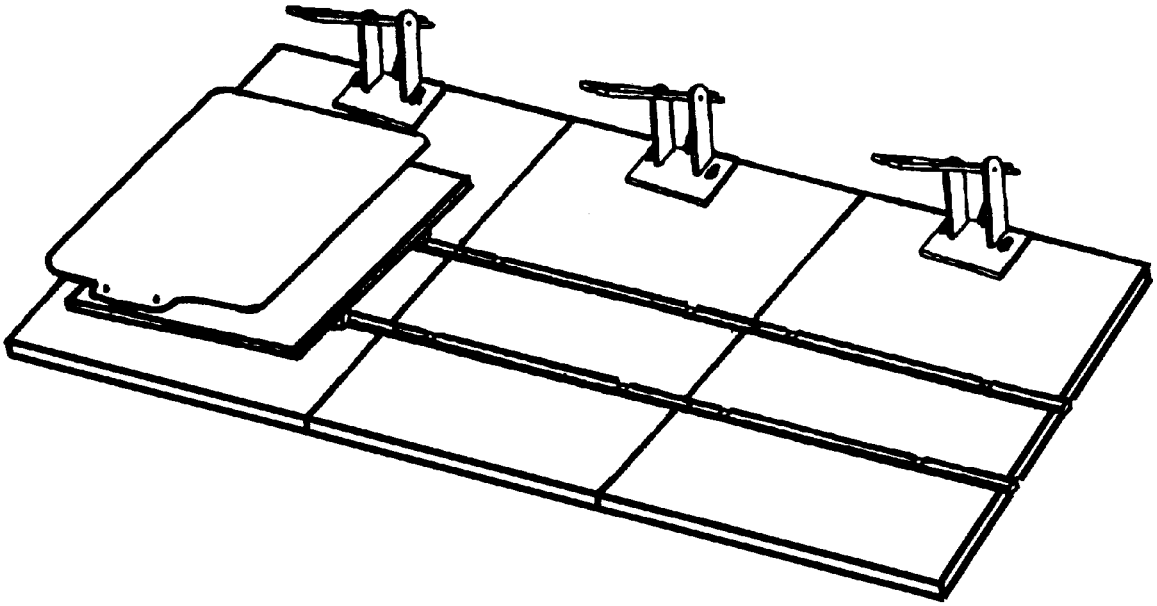
FIG. 6 is a perspective view of three interconnected modular printer platforms, each with its own screen tower, and with the rolling chase in position such that the system is now ready for the attachment and registry of the silk screens.
Figure 7:
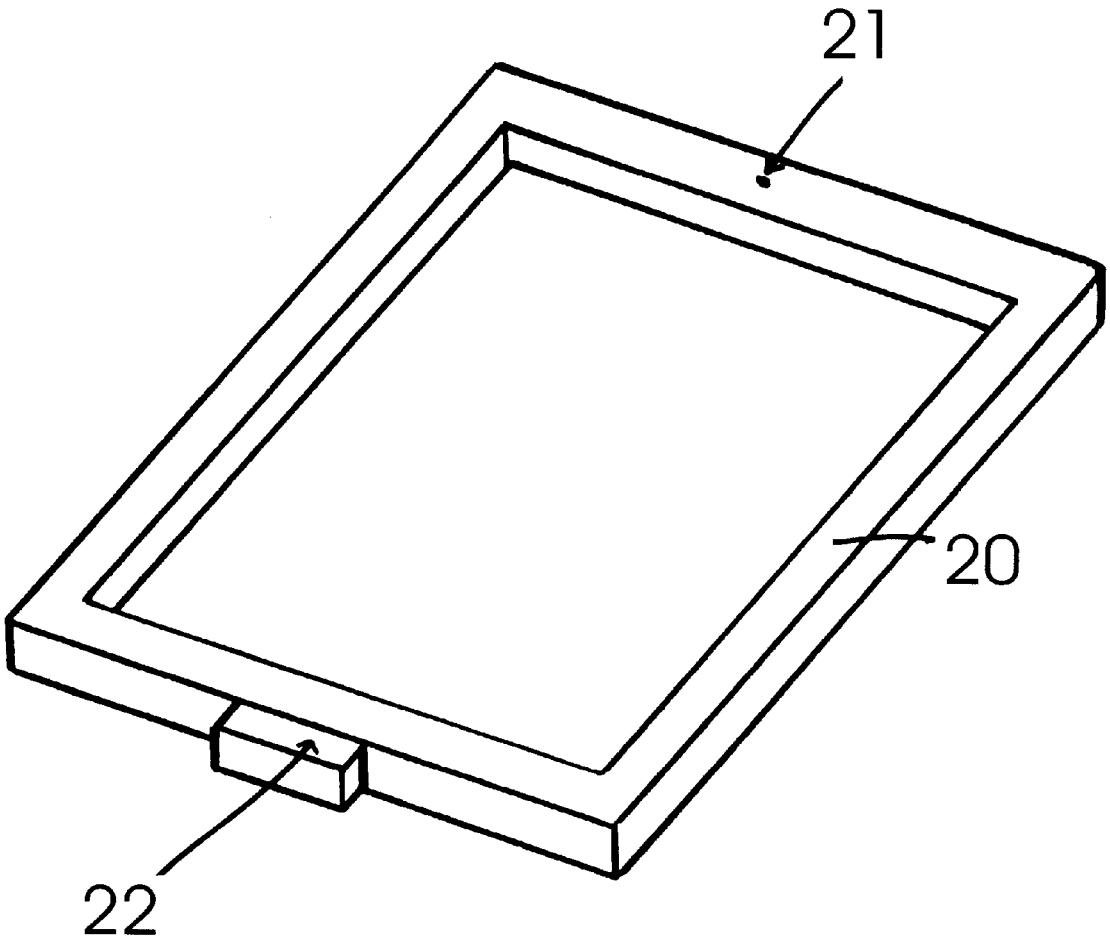
FIG. 7 is a perspective view of a screen frame.
Figure 8:
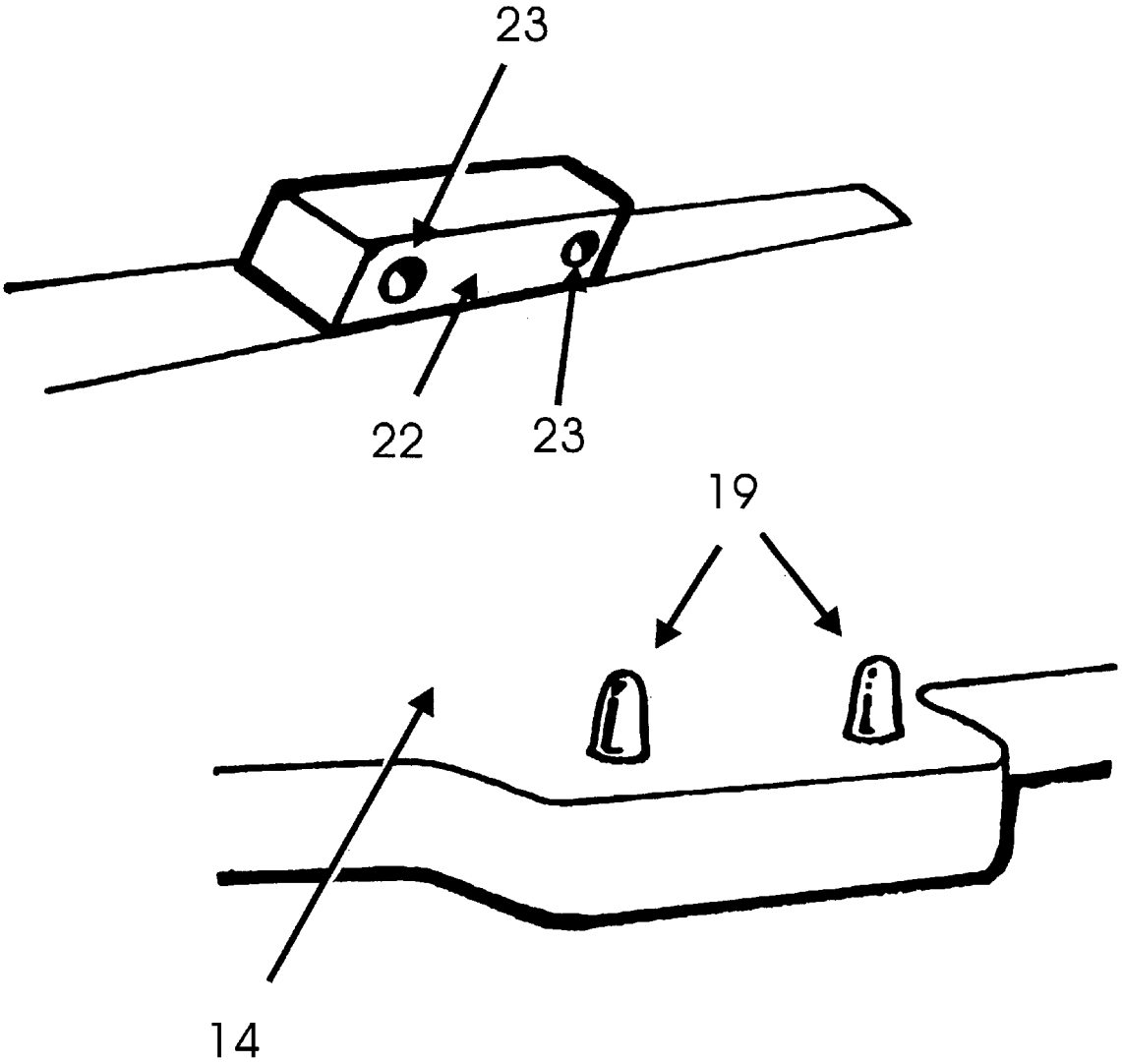
FIG. 8 is a schematic representation in semiperspective of the underside of the registry block of the screen in FIG. 7 relative to the registry alignment pins shown on the upper surface of the rolling chase.
Figure 9A:
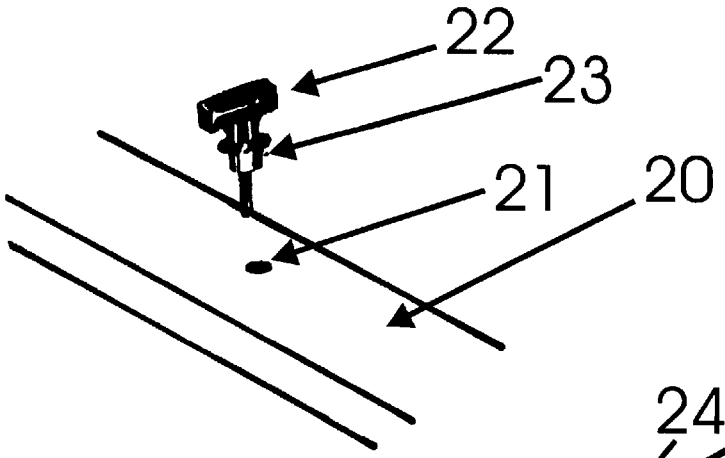
FIGS. 9A through 9C illustrate, in sequence, the connecting of the screen to the screen tower.
Figure 9B:
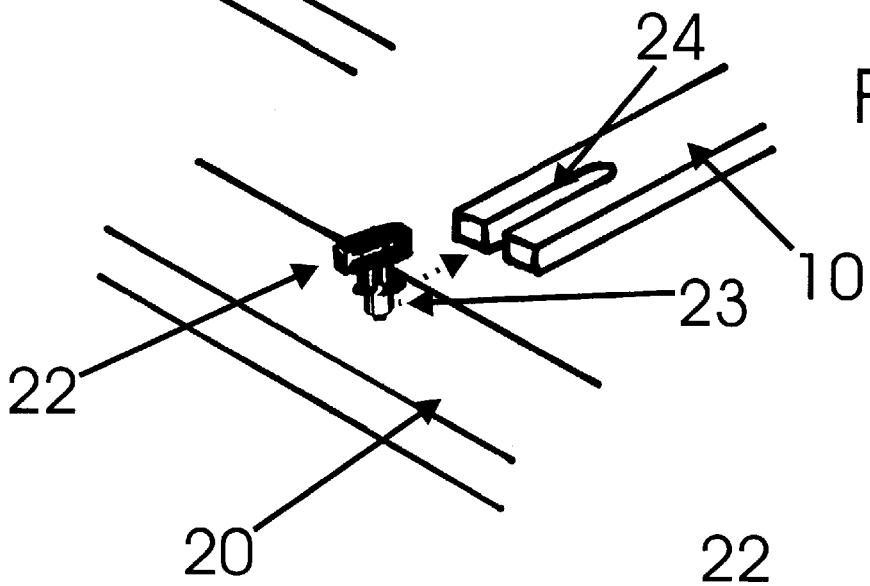
Figure 9C:
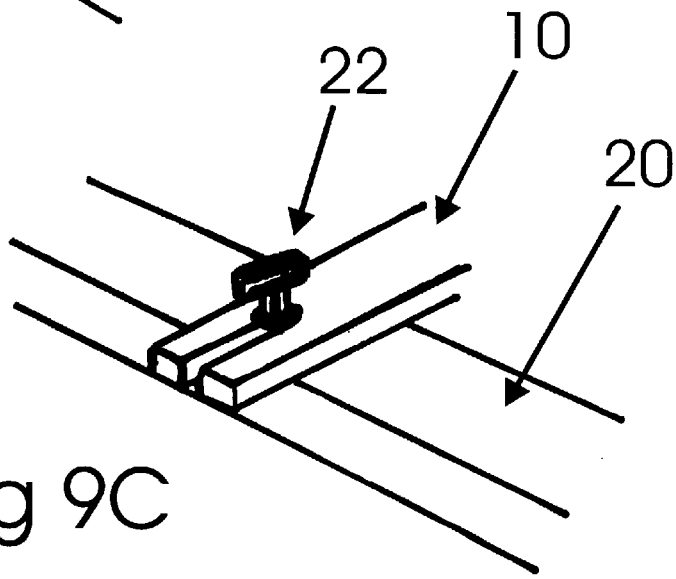

FIG. 5D shows the rolling chase being placed in position on the modular printer platform. FIG. 6 shows the rolling chase in position in a three color system in which three of the modular printing platforms are joined, with screen towers in place, ready for printing screen attachment and registry. FIG. 7 illustrates a typical silk screen printing frame 20, modified for the purpose of this invention by the inclusion of mounting hole 21 in alignment block 22. FIG. 8 shows the underside of mounting block 22 with alignment holes 23 positioned so as to align with registry pins 19 in fabric platform 14. To attach the screens to the screen tower, a T-bolt or twist screw 22 is inserted into the hole 21 of the screen frame with an appropriate spacer 23 placed between the head of the twist screw and the screen frame. The T-bolt is tightened and then, as shown in FIG. 9B, a slot 24 in screen support arm 10 is positioned between the head of twist screw 22 and screen frame 20 to enclose the spacer 23. At this point, the twist screw is still slightly loose so that the screen can slide in slot 24 relative to the screen support arm 10. Referring back to FIG. 8, the screen frame 20 and the screen support arm 10 are caused to pivot until, with reference to FIG. 8, the alignment holes 23 in registry block 22 encompass registry pins 19 of fabric support 14. When this registry and alignment is completed, T-bolt 22 is tightened down and thereafter the screen will remain in registry with respect to the rolling chase every time the rolling chase is positioned with the wheels properly located in notches 3 of tracks 2 for that particular modular printer platform. The tightened down and attached screen is now pivoted upward to an upright position and the rolling chase is now moved to station 2 where the process is again repeated, only this time with the screen that has been prepared for the color to be applied at position two, and when this process is completed, it is again then moved to position three, and so forth.

Figure 10A:
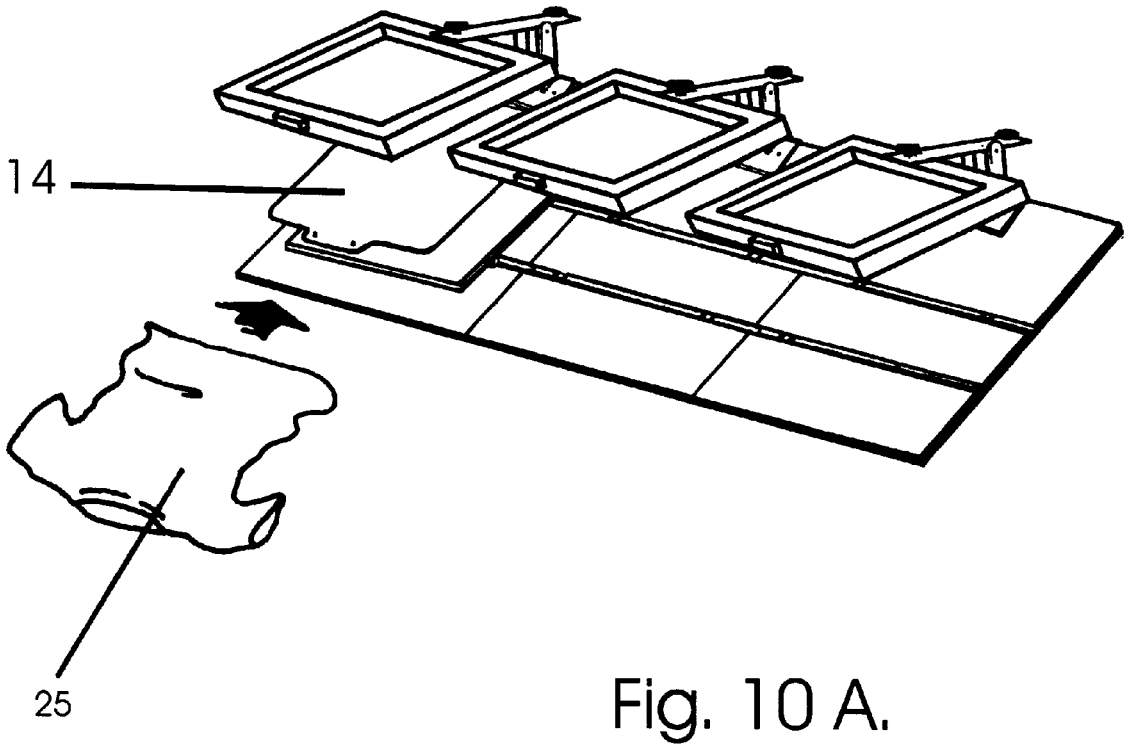
FIGS. 10A and B show the sequence of steps in the placing of a T-shirt or other material to be printed onto the print surface of the rolling chase with the rolling chase and print screens in place on the modular platforms of the present invention.
Figure 10B:
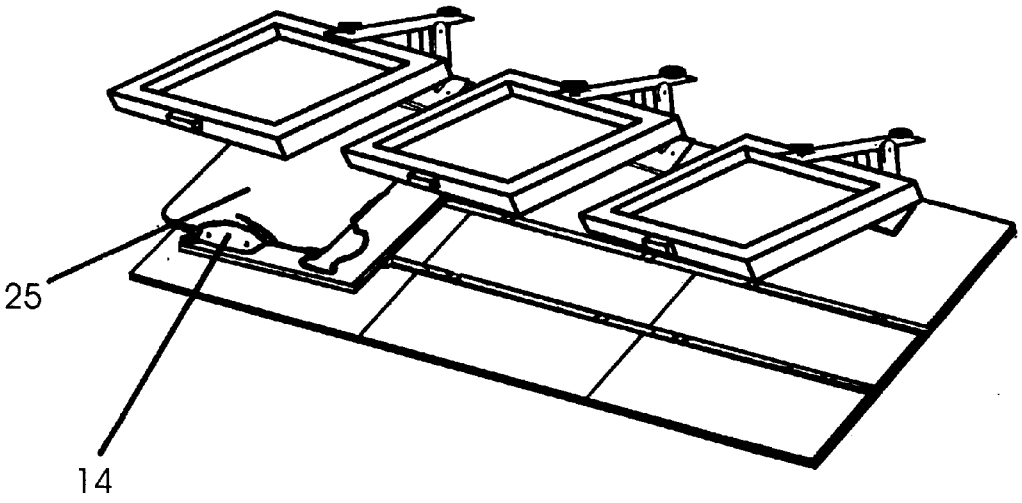

FIG. 10A and 10B provide a schematic representation of the treatment of a T-shirt. As shown in the schematic drawing, the screens are in place, raised above the printing location, and the rolling chase is in position 1. T-shirt 25 is slid over the fabric platform 14 and pulled tight into position as shown in FIG. 10B, to be held in place for the printing operation. At this point in time, the system is ready for printing.

Figure 11A:
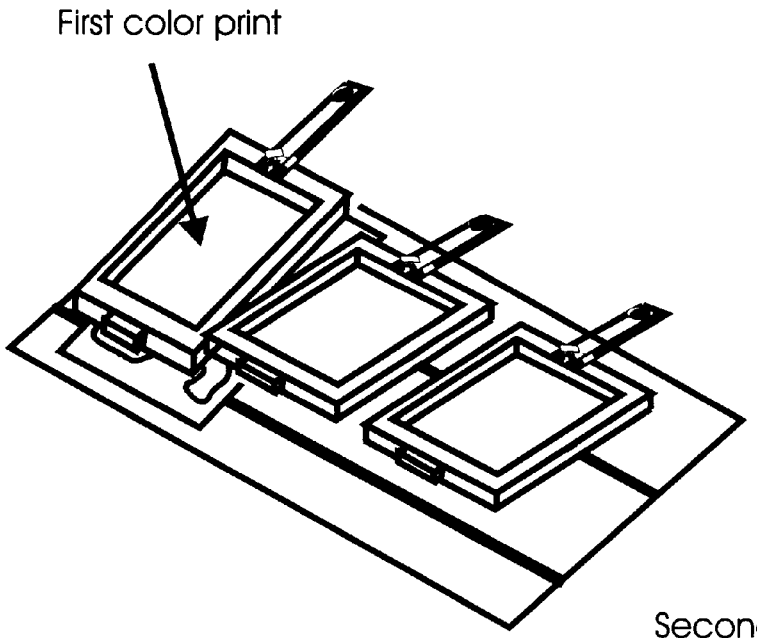
FIGS. 11A through C represent, schematically, the sequence of steps for the printing process using the device of the present invention.
Figure 11B:
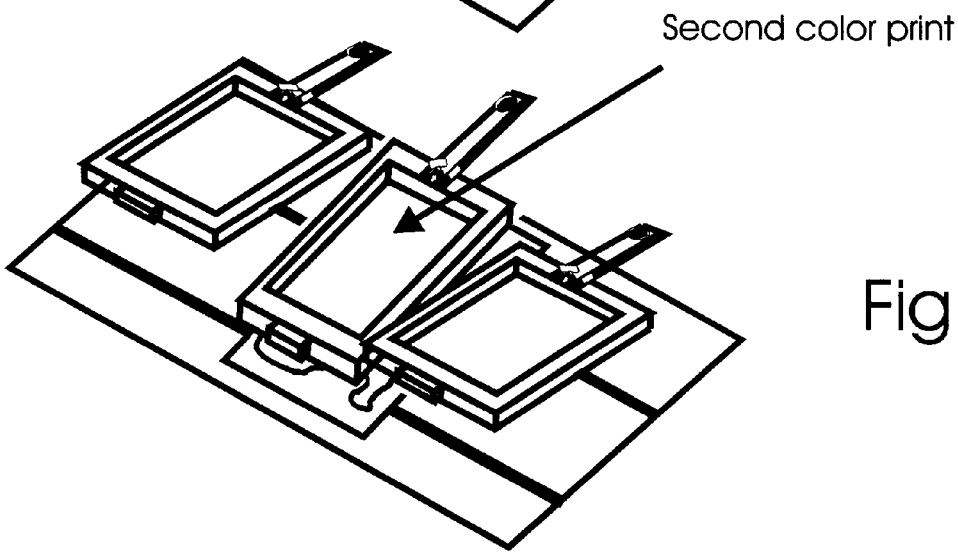
Figure 11C:
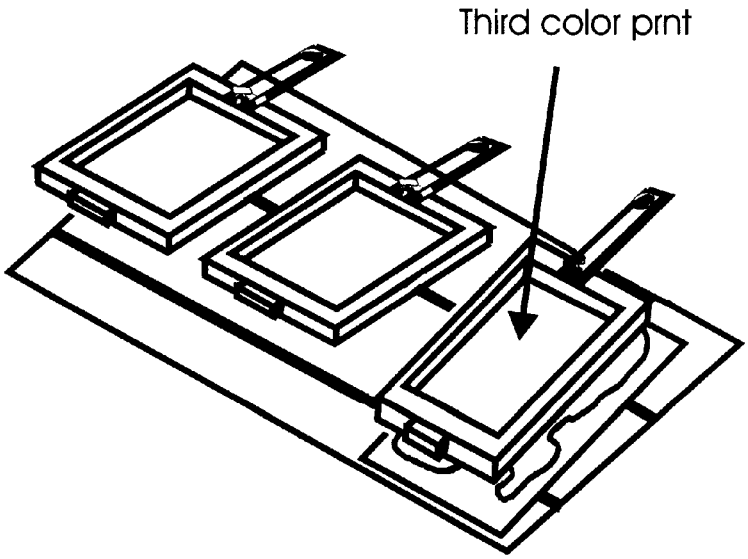

FIGS. 11A through 11C schematically represent the printing operation. As shown in FIG. 11A, the first screen is pulled down over the rolling chase with its T-shirt on the fabric platform and ink is applied to the screen and squeegeed in place, as is the normal case. The screen is then raised, the rolling chase is moved over to position two, as shown in FIG. 11B, and the second screen is now pulled down and put through the same process with the second color. When that is completed, the second screen is again raised, the rolling chase is moved to the third position, the third color is printed in the same manner as shown in FIG. 11C.

One of the significant advances of the present invention is the ease with which in-line drying may be accomplished. For the purpose of the present invention, the Black Body Screen Print Dryer produced by B.B.C. Industries, Inc. of Fenton, Mo., is a suitable radiant dryer for the purposes herein.

FIGS. 12 through 16 illustrate a heater support member that is compatible with the modular system of the present invention. As can be seen, the support is basically T-shaped, having a base 26 and an upright portion 27, with the upright portion 27 having pair of shelf support structures 28 of the type commonly used for bookshelves. The reverse side of the structure is shown in FIG. 13 in which two T-bolts or twist screws 29 are provided for insertion into holes 30. Holes 30 are spaced to correspond to the spacing of holes 5 (FIG. 1) in the modular platform so that the heater support can be mounted to the modular platform in essentially the same manner that the screen towers are mounted to the platform, thereby permitting the use of an identical platform for multiple purposes, identical in all regards including the tracks 2 with notches 3.

Figure 14:
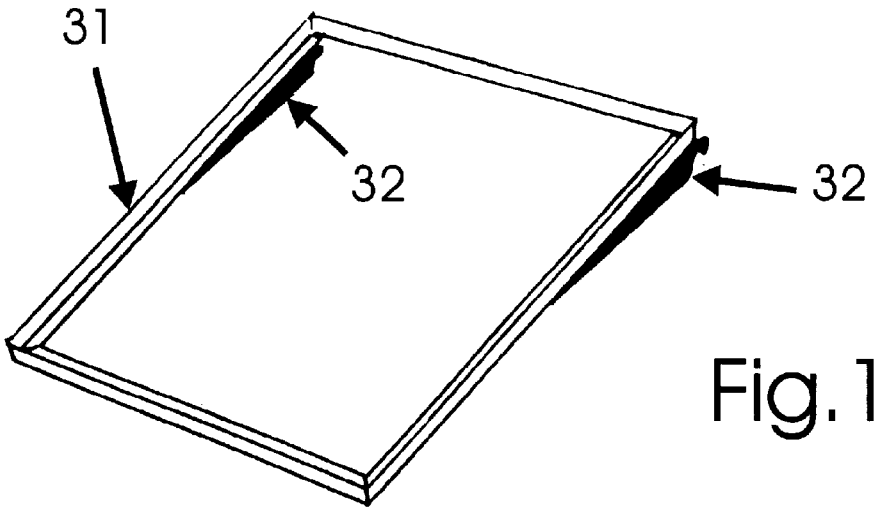
FIG. 14 is a perspective view of a heater support frame adapted to be mounted to the heater support of FIG. 12.
Figure 15:
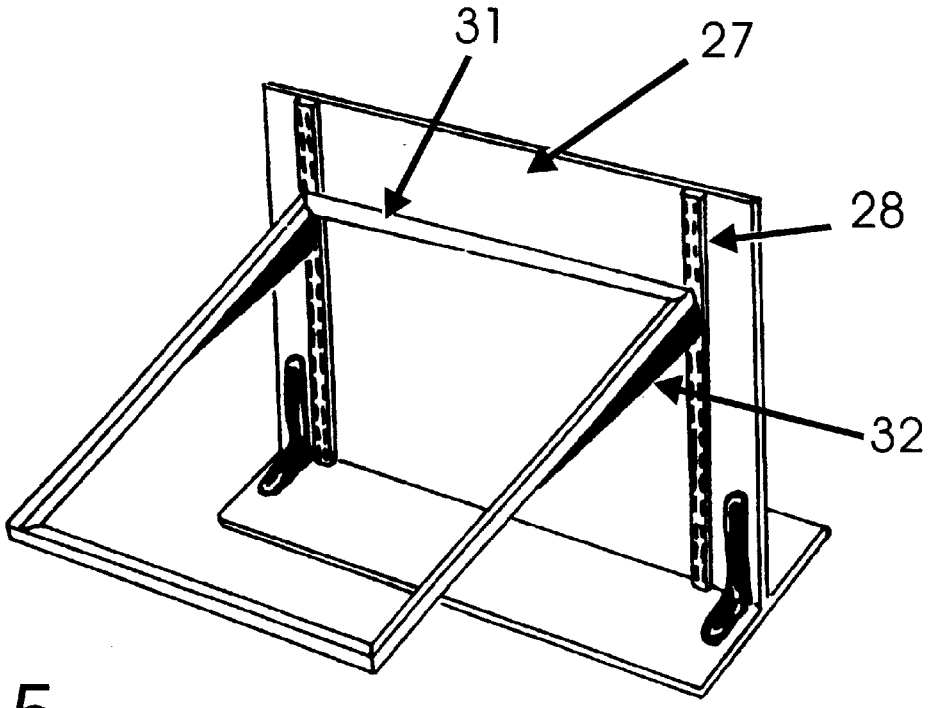
FIG. 15 is a perspective view of the heater support frame mounted to the heater support.
Figure 16:
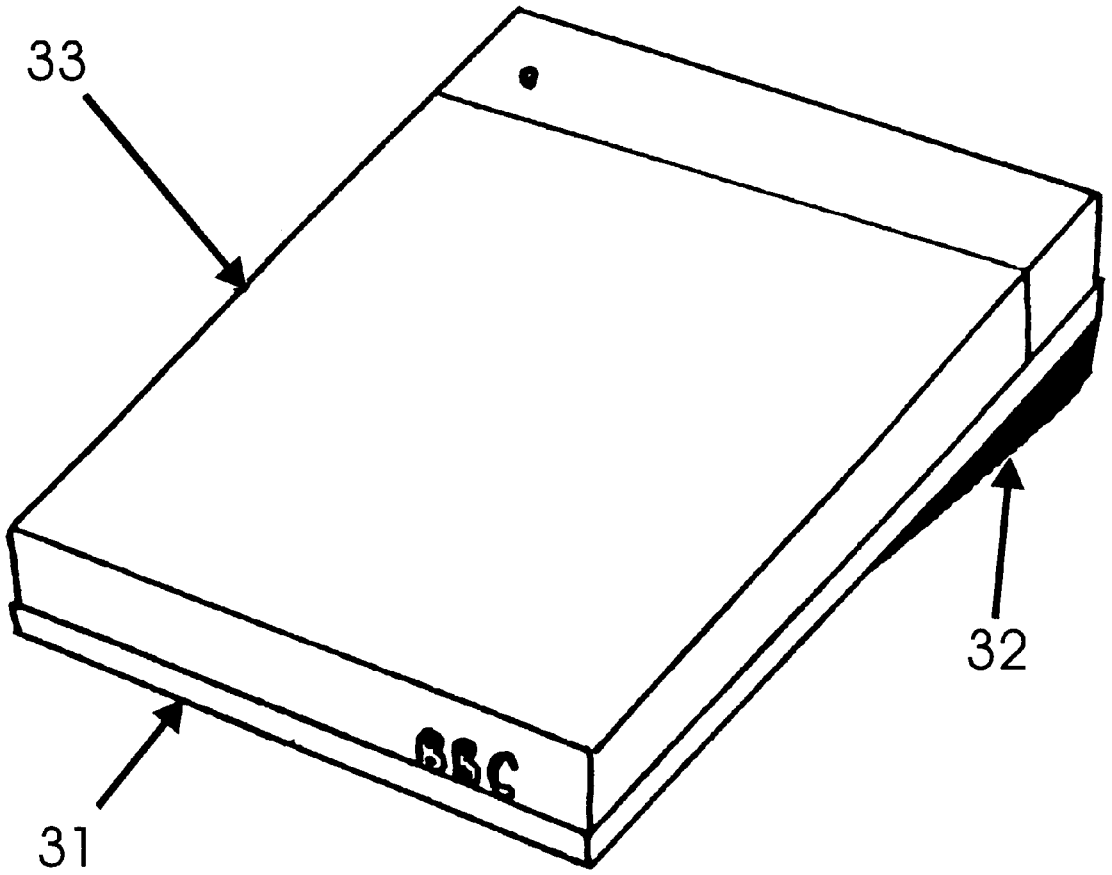
FIG. 16 is a schematic view of a typical silk screen print heater resting in place in the frame of FIG. 14.

As shown in FIG. 14, a heater support frame 31 is provided with shelving hardware 32 to permit the frame to be mounted on the heater support 27, as shown in FIG. 16. As is shown in FIG. 16 schematically, the heater 33 can be placed into the frame where it will rest and be held for use as shown in FIG. 16. Just as the rolling chase can be brought into different positions for printing purposes, the rolling chase bearing the completely printed product can then be moved under the heater for drying. Thus, the user of the equipment can provide a sequential modular printing system in which the product being printed will at all times be in registry for printing purposes and for drying purposes, if drying is desired, and once the initial settings for the system have been established, no registry changes will occur. Because, however, the system is modular, it takes very little time to knock it down or assemble it, and in the knock-down condition, it is possible to package it in a relatively small package that can be readily carried on a hand truck. Insofar as can be determined, none of the prior art devices provide this feature and, in particular, provide it under circumstances in which essentially perfect registry is obtained throughout the entire operation with no adjustments being required during the course of the proceedings.

While the invention has been described specifically with regard to the printing of T-shirts, it can be readily adjusted to be used with sweat shirts or any other fabric that can be affixed to the shirt platform of the rolling chase. Further, while the invention is described in its preferred embodiment using a rolling chase, it is possible to omit wheels and rely on glides and sliding contract provided proper care is taken to provide registry means for the movable fabric-holding platform so that it is in proper position at each modular unit.

What is claimed is:

1. A multicolor silk screen printing apparatus of modular design comprising:

a plurality of independent modular printer platforms being removably connected to each other;

a plurality of screen printing towers, each of said screen printing towers being provided with a pivotally mounted screen support arm adapted to receive and register a silk screen frame;

said screen printing towers being rigidly and removably mounted on said respective independent modular printer platforms;

each of said independent modular printer platforms being provided with parallel guide tracks on its top surface; said parallel guide tracks of each said printer platform interconnecting with the parallel guide tracks of the adjacent printer platforms to form continuous parallel guide tracks when said plurality of independent modular printer platforms are connected to each other;

a fabric-holding platform being placed on said connected printer platforms and moved along said continuous parallel guide tracks through said plurality of said screen printing towers so as to carry out the multicolor screen printing on the fabric; and said fabric-holding platform having wheels disposed at its bottom side and engaging with said continuous parallel guide tracks in carrying out the rolling motion of the fabric-holding platform along the continuous parallel guide tracks.

2. A multicolor silk screen printing apparatus in accordance with claim 1 further comprising a fabric drying heater capable of being mounted on one of said independent modular printer platforms in place of said screen printing tower immediately adjacent one of the rest of said screen printing towers.

* * * * *